US007104335B2

(12) United States Patent
Shim

(10) Patent No.: US 7,104,335 B2
(45) Date of Patent: Sep. 12, 2006

(54) SPRINKLER HEAD

(75) Inventor: Dae-Min Shim, Seoul (KR)

(73) Assignees: Paradise Industry Co., Ltd., Gyeonggi-Do (KR); Tadashi Hattori, Kinwada (JP)

( * ) Notice: Subject to any disclaimer, the term of this patent is extended or adjusted under 35 U.S.C. 154(b) by 0 days.

(21) Appl. No.: 10/516,658

(22) PCT Filed: Dec. 23, 2003

(86) PCT No.: PCT/KR03/02818

§ 371 (c)(1),
(2), (4) Date: Dec. 1, 2004

(87) PCT Pub. No.: WO2004/056422

PCT Pub. Date: Jul. 8, 2004

(65) Prior Publication Data

US 2006/0042802 A1 Mar. 2, 2006

(30) Foreign Application Priority Data

Dec. 23, 2002 (KR) ..... 20-2002-0038143

(51) Int. Cl.
*A62C 37/08* (2006.01)

(52) U.S. Cl. ..... 169/37; 169/42; 169/5; 169/DIG. 3

(58) Field of Classification Search ..... 169/5, 169/37–72, DIG. 3
See application file for complete search history.

(56) References Cited

U.S. PATENT DOCUMENTS

| | | | | | |
|---|---|---|---|---|---|
| 4,217,960 | A | * | 8/1980 | Miyazaki | 169/38 |
| 4,660,648 | A | * | 4/1987 | Zen | 169/38 |
| 4,785,888 | A | * | 11/1988 | Blum et al. | 169/39 |
| 4,977,963 | A | * | 12/1990 | Simons | 169/37 |
| 6,044,912 | A | * | 4/2000 | Tsuji et al. | 169/37 |
| 6,152,236 | A | * | 11/2000 | Retzloff et al. | 169/57 |
| 6,439,315 | B1 | * | 8/2002 | Onuki | 169/37 |

FOREIGN PATENT DOCUMENTS

| | | |
|---|---|---|
| JP | 07250912 | 10/1995 |
| JP | 08131575 | 5/1996 |
| JP | 2002078814 | 3/2002 |

* cited by examiner

*Primary Examiner*—Dinh Q. Nguyen
*Assistant Examiner*—Seth Barney
(74) *Attorney, Agent, or Firm*—Cohen, Pontani, Lieberman & Pavane

(57) ABSTRACT

A sprinkler head having a first housing connected to a water supply pipe disposed inside a building ceiling. The sprinkler head includes a second housing coupled to the first housing and fixed to the ceiling surface. A deflector is adhered to the first housing for spraying water by being detached from the first housing. A locking unit is locked inside the second housing for maintaining the sealing state between the deflector and the second housing, and a heat responding unit is exposed to outside of the ceiling for sensing heat at the time of a fire occurrence and thus releasing a locking of the locking unit.

3 Claims, 7 Drawing Sheets

SPRINKLER HEAD

PRIORITY CLAIM

This is a U.S. national stage of application No. PCT/KR2003/002818, filed on Dec. 23, 2003. Priority is claimed on that application and on the following application(s): Country: Korea, Application No.: 38143/2002, Filed: Dec. 23, 2002.

FIELD OF THE INVENTION

The present invention relates to a sprinkler head, and more particular, to a sprinkler head capable of being protected from an external impact by minimizing an exposure distance of the sprinkler head from a ceiling surface, capable of fast suppressing a fire at the time of occurrence of a fire by accelerating a reaction speed, and capable of adorning the indoor with a lovely view.

DISCUSSION OF RELATED ART

FIG. 1 is a sectional view of a sprinkler head according to one embodiment in accordance with the conventional art.

The sprinkler head according to one embodiment in accordance with the conventional art comprises: a first housing 104 connected to a water supply pipe 102 disposed inside a ceiling 106; a second housing 110 coupled to the first housing 104 and disposed at a penetration hole 108 formed at the ceiling 106; a deflector 112 disposed in the second housing 110 and adhered to the first housing 104 in a sealing-available manner, for maintaining a sealing state of the first housing 104 in the ordinary time and spraying water all around at the time of a fire occurrence by being detached from the first housing 104; a locking unit 114 locked at an inner circumferential surface of a lower end of the second housing 110 for supporting the deflector 112 and thus maintaining the sealing state of the first housing 110; and a heat responding unit 116 exposed to outside of the ceiling 106 for sensing heat at the time of a fire occurrence and thus releasing a locking of the locking unit 114.

The deflector 112 includes: a deflector ring 130 inserted to an outer circumferential surface of a lower side of the second housing 104 in a linear-movable manner; a sealing cap 134 adhered to a lower surface of the second housing 104 for sealing the second housing 104; a water spray plate 136 fixed to an outer circumferential surface of the sealing cap 134 for spraying water all around at the time of a fire occurrence; and a plurality of legs 132 for connecting the deflector ring 130 and the water spray plate 136.

The locking unit 114 includes: a first loading plate 120 contacting a rear surface of the sealing cap 134 of the deflector 112, having a screw hole 128 at the center thereof, and having an inclination surface at the edge thereof; a second loading plate 122 facing the first loading plate 120 and having an inclination surface at the edge thereof; and a locking ring 124 disposed at the inclination surface between the first loading plate 120 and the second loading plate 122 and widened when the first loading plate 120 and the second loading plate 122 are adhered to each other thus to be locked in a locking groove 126 formed at an inner circumferential surface of a lower side of the second housing 110.

The heat responding unit 116 includes: a heat collecting cap 138 mounted at a lower side of the second loading plate 122 for heat-collecting at the time of a fire occurrence; a fuse metal 140 mounted at a lower surface of the heat collecting cap 138 and melted when heat transmitted through the heat collecting cap 138 reaches a certain temperature; and a locking screw 142 coupled to the screw hole 128 formed at the first loading plate 120 for integrally coupling the first and second loading plates 120 and 122, the heat collecting cap 138, and the fuse metal 140.

In the sprinkler head according to one embodiment of the conventional art, when a fire breaks out, the heat collecting cap 138 is heated thus to transmit heat to the fuse metal 140 mounted at the lower side of the heat collecting cap 138. Then, when the temperature of the heat transmitted to the fuse metal 140 reaches a preset temperature, the fuse metal 140 is melted and thereby the interval between the first loading plate 120 and the second loading plate 122 is widened. According to this, the locking ring 124 is restored to the original state thus to be detached from the locking groove 126 formed at the second housing 104.

Then, the locking unit 114 and the heat responding unit 116 are detached from the second housing 104, and the deflector 112 is moved downwardly, thereby locking the deflector ring 130 in the locking groove 126 of the second housing 104. At this time, the sealing state of the second housing 104 is released and thereby water is drained through the second housing 104. The water is sprayed all around by the water spray plate 136 of the deflector 112 thus to suppress fire.

However, in the sprinkler head according to one embodiment of the conventional art, an upper side of the heat collecting cap for collecting heat at the time of a fire occurrence is formed as an open cylindrical shape. According to this, even if the appearance of the heat collecting cap is lovely, a heat transmission area is relatively small thus to lower a heat collecting ability, thereby to lower a reaction speed, and to degrade a reliability of the product.

As the reaction speed of the sprinkler at the time of a fire occurrence is very important, if the reaction speed is lowered, an initial fire suppression is impossible and thereby a big fire can be caused.

In order to solve said problem, a sprinkler head according to another embodiment of the conventional art was disclosed.

FIG. 2 is a sectional view of a sprinkler head according to another embodiment in accordance with the conventional art.

The sprinkler head according to another embodiment of the conventional art is the same as the aforementioned sprinkler head according to one embodiment of the conventional art except a heat responding unit for collecting heat.

The heat responding unit 150 of the sprinkler head according to another embodiment of the conventional art includes: a first heat collecting plate 152 disposed at a lower side of the second loading plate 122; a second heat collecting plate 154 having a diameter smaller than that of the first heat collecting plate 152 and disposed at a lower side of the first heat collecting plate 152 with a certain gap; and a third heat collecting plate 156 having a diameter smaller than that of the second heat collecting plate 154 and disposed at a lower side of the second heat collecting plate 154 with a certain gap.

In the heat responding unit 150 according to another embodiment of the conventional art, a heat collection is performed through the first heat collecting plate 152, the second heat collecting plate 154, and the third heat collecting plate 156, so that a heat transmission area becomes wide and a reaction speed becomes fast.

The second housing 104, as aforementioned in the first embodiment, is disposed on the same plane as the lower surface of the ceiling 106, and is fixed to the ceiling 106 by a bracket 160. The locking groove 126 formed at the second housing 104 is formed at the end of the lower side of the second housing 104 thus to lock the locking unit 114.

However, in the sprinkler head according to another embodiment of the conventional art, since the locking groove 126 is formed at the end of the lower side of the second housing 104, the locking unit 114 composed of the locking ring 124, the first loading plate 120, and the second loading plate 122 is entirely protruded from the lower surface of the ceiling 106. According to this, the height H that the locking unit 114 is protruded from the ceiling 106 is increased correspondingly. Also, since the intervals among the first, second, and third heat collecting plates 152, 154, and 156 are comparatively wide, the height H becomes greater.

As above-explained, since the height that the sprinkler head is protruded from the ceiling is increased, a probability that an external impact is to be applied to the sprinkler head is high at the time of the ceiling construction or the indoor work. According to this, the sprinkler head is damaged or mal-functioned by the impact, so that an accurate operation is not performed at the time of a fire occurrence.

Additionally, since the interval between the ceiling surface and the first heat collecting plate or the interval between each heat collecting plate is comparatively wide, heated air flow which has been elevated to the ceiling at the time of a fire occurrence passes through each heat collecting plate along the ceiling with a fast speed as the arrow P of drawing. According to this, a heat transmission to each heat collecting plate is not surely performed thus to lower the reaction speed.

OBJECTS AND SUMMARY OF THE INVENTION

Therefore, an object of the present invention is to provide a sprinkler head capable of enhancing a reliability of a product by preventing a sprinkler from being damaged or malfunctioned, in which an impact applied to the sprinkler head is minimized at the time of a ceiling construction or an indoor work by positioning the sprinkler head to the ceiling surface as close as possible.

Another object of the present invention is to provide a sprinkler head capable of enhancing a function of a product by accelerating a reaction speed at the time of a fire occurrence by improving a structure of a heat responding unit exposed to outside from the ceiling.

Still another object of the present invention is to provide a sprinkler head having a fine appearance by reducing a height of the sprinkler head exposed from the ceiling.

In order to achieve the above objects, there is provided a sprinkler head comprising: a first housing a first housing connected to a water supply pipe disposed inside a building ceiling; a second housing coupled to the first housing and fixed to the ceiling surface; a deflector adhered to the first housing in a sealing-available manner for spraying water all around at the time of a fire occurrence by being detached from the first housing; a locking unit locked inside the second housing for maintaining the sealing state between the deflector and the second housing; and a heat responding unit exposed to outside of the ceiling for sensing heat at the time of a fire occurrence and thus releasing a locking of the locking unit.

The second housing is provided with a locking groove formed in a circumferential direction at an inner side with a prescribed height from a lower surface of the second housing. The locking groove having a locking ring locked at the locking groove and having first and second loading plates for pressurizing the locking ring thus to widen is inserted into the second housing with a certain height.

An air flow collecting portion for collecting air flow heated when a fire breaks out and generating a swirl flow is formed at a lower portion of the second housing.

The heat responding unit is composed of first, second, and third heat collecting plates, and the first, second, and the third heat collecting plates have certain intervals therebetween in order to delay time that air flow passes at the time of a fire occurrence.

DESCRIPTION OF THE PREFERRED EMBODIMENTS

Figure 1:
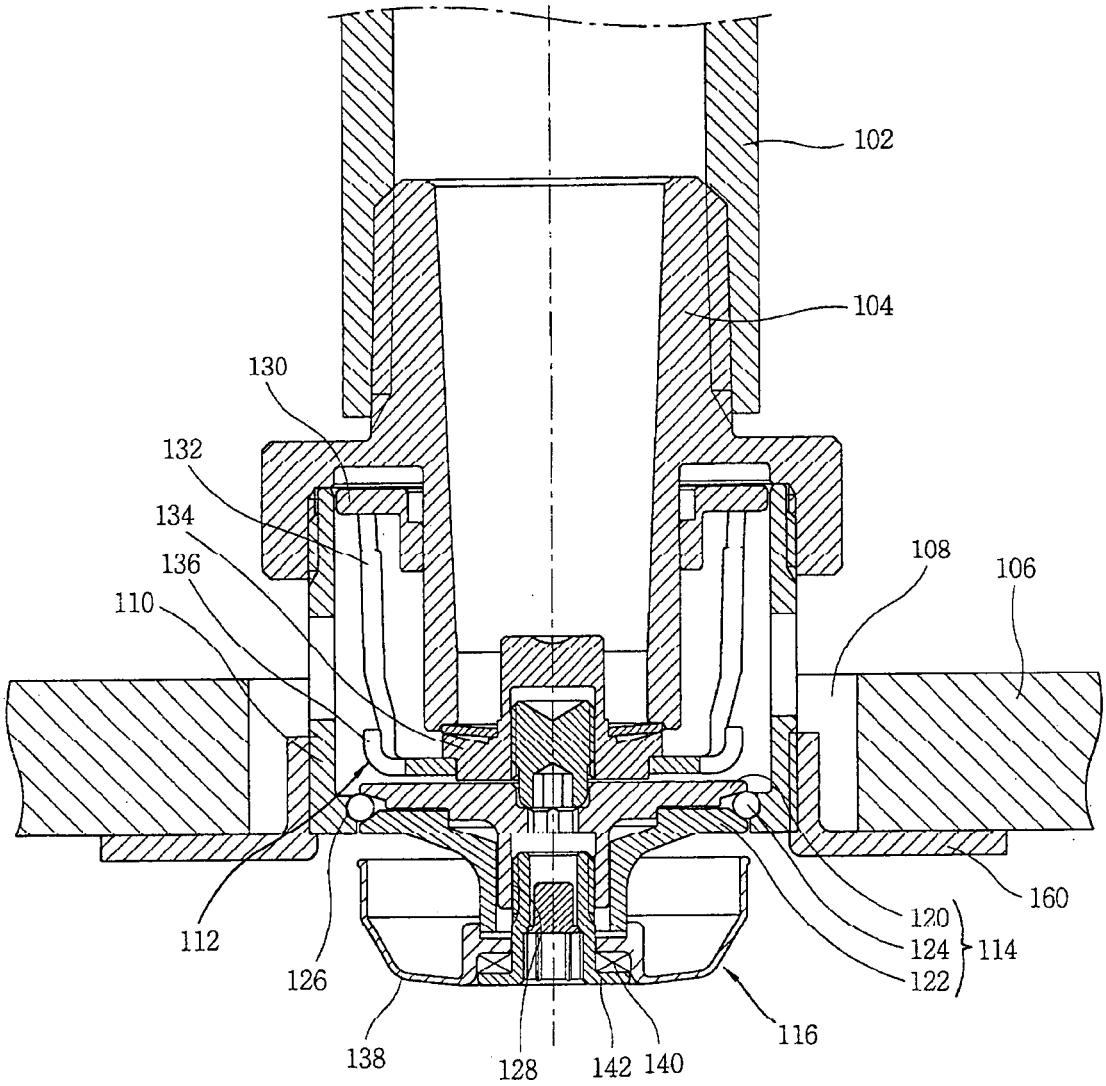
FIG. 1 PRIOR ART
FIG. 1 is a sectional view of a sprinkler head according to one embodiment in accordance with the conventional art.
Figure 2:
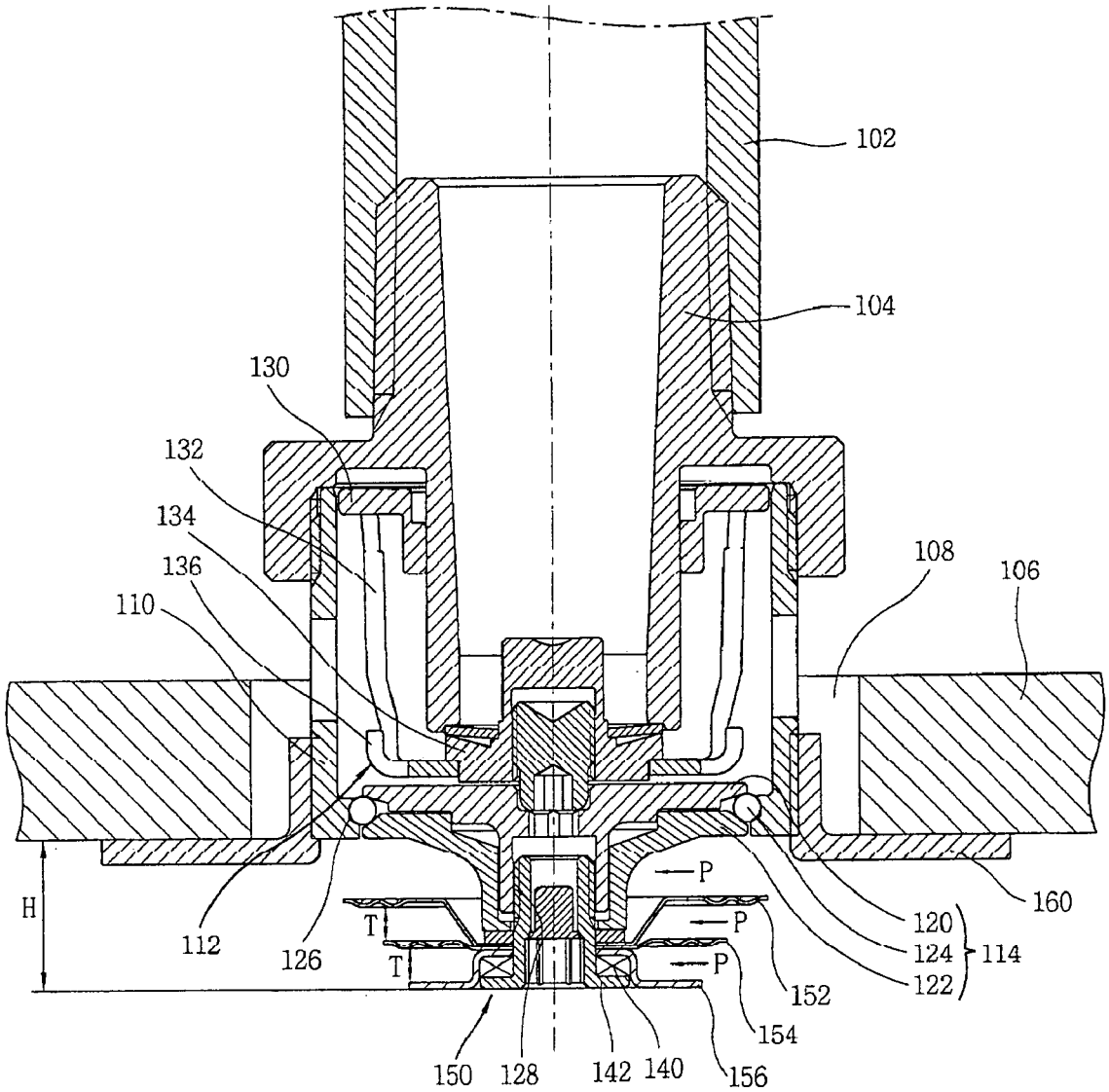
FIG. 2 PRIOR ART
FIG. 2 is a sectional view of a sprinkler head according to another embodiment in accordance with the conventional art.
Figure 3:
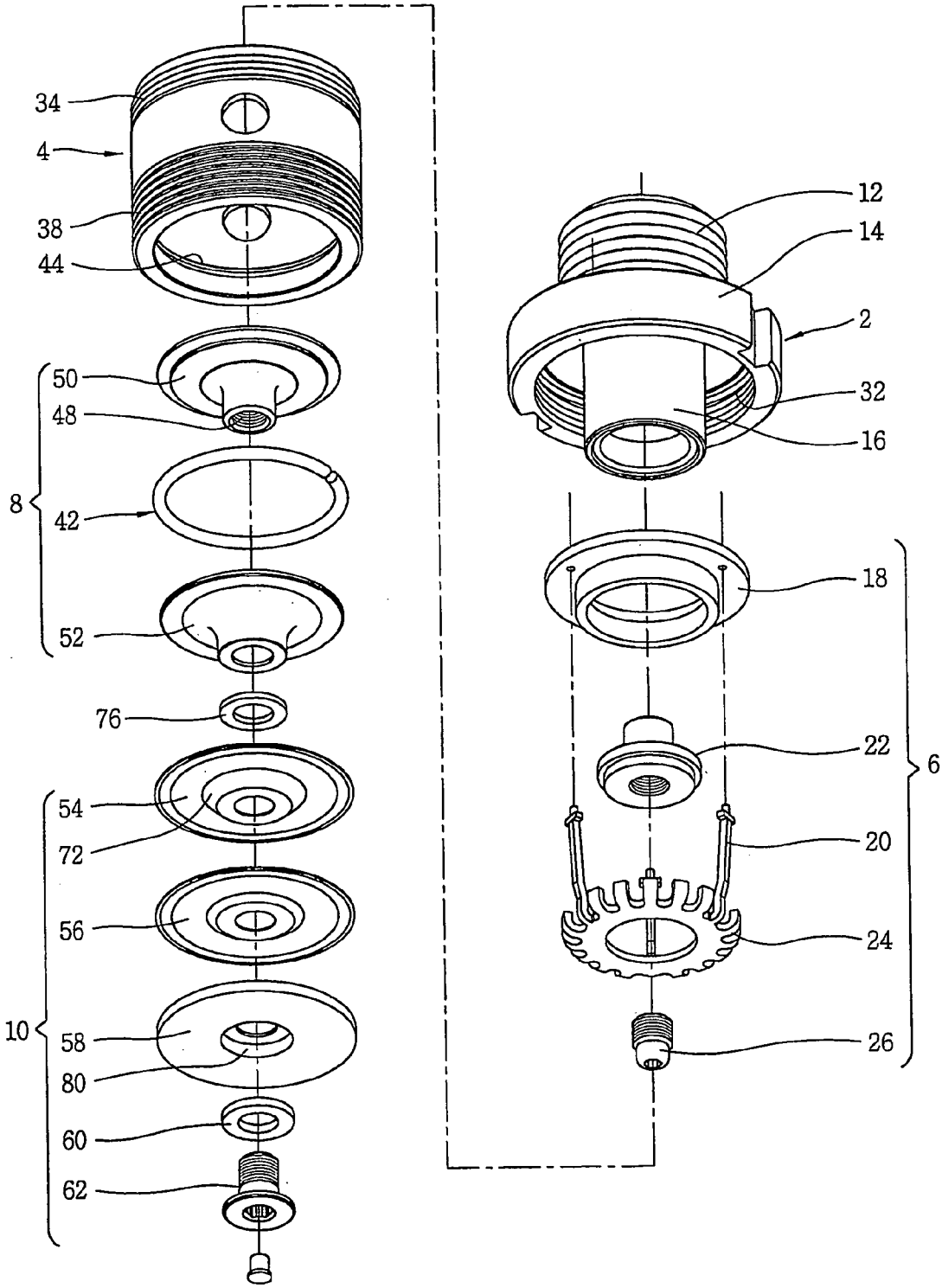
FIGS. 3 and 4 are disassembled perspective views of a sprinkler head according to the present invention.
Figure 4:
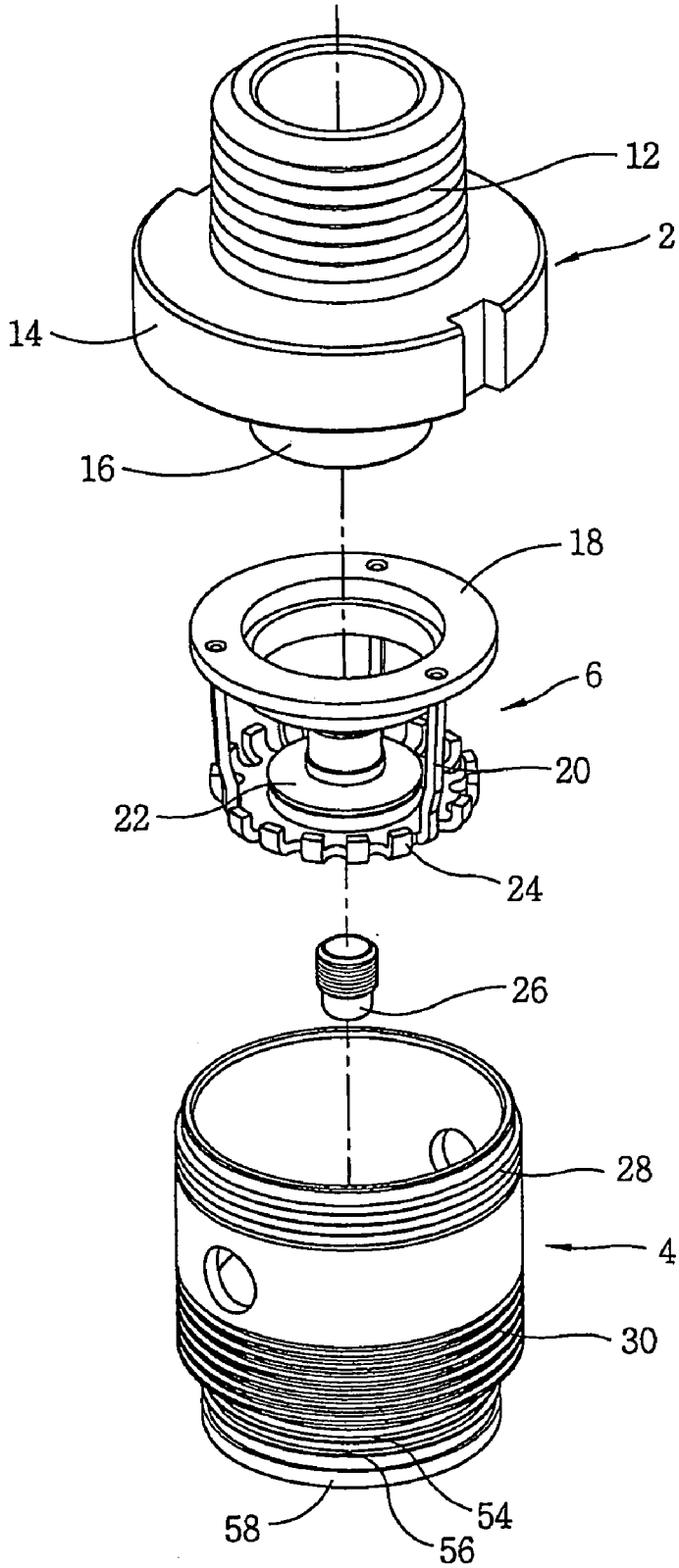
Figure 5:
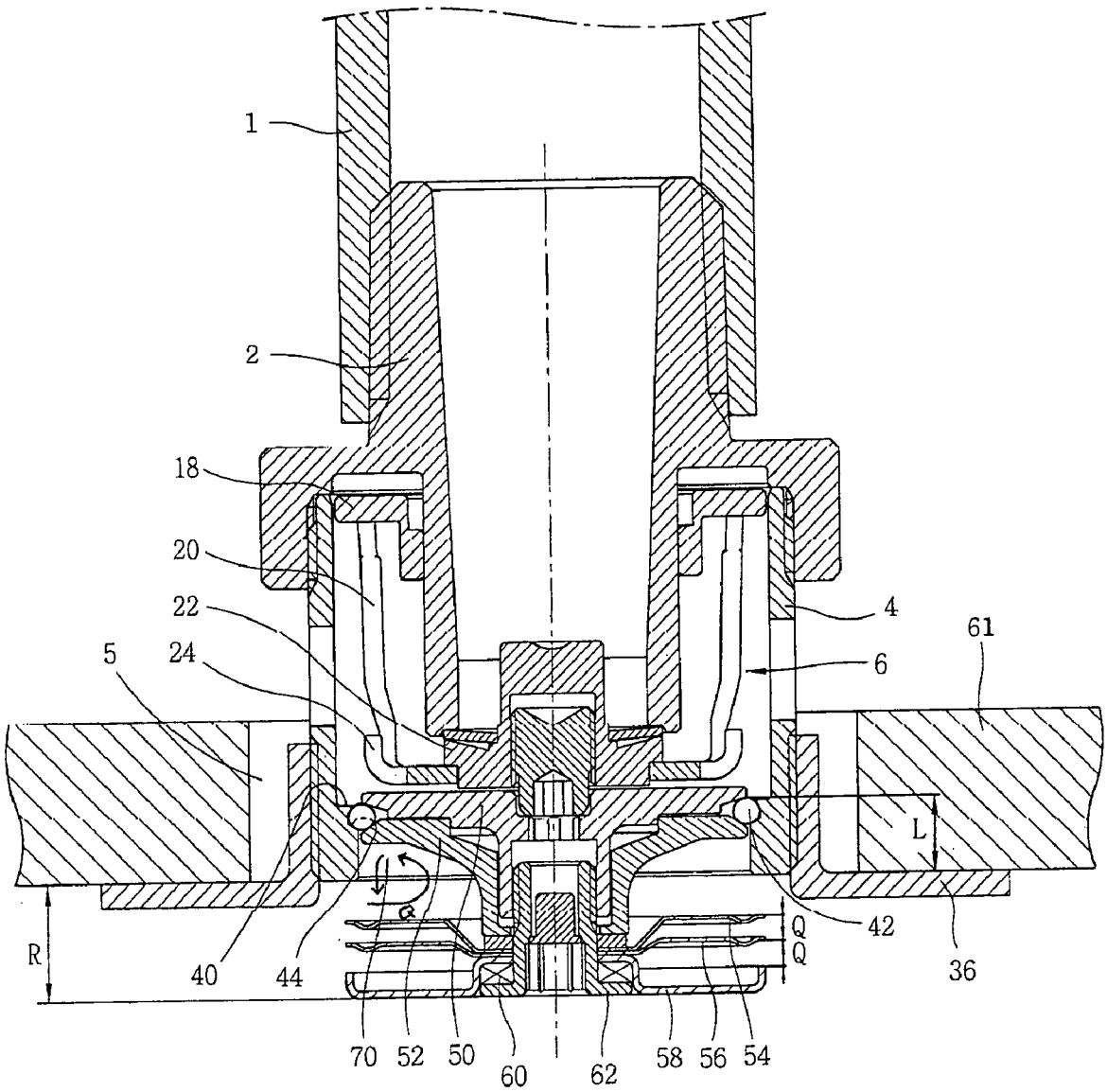
FIG. 5 is an engagement sectional view of the sprinkler head according to the present invention.

The present invention will now be described with reference to accompanying drawings.

Even though a plurality of preferred embodiments of the sprinkler head according to the present invention can exist, the most preferred embodiment will be explained.

The sprinkler head according to the present invention comprises: a first housing 2 connected to a water supply pipe 1 disposed inside a building ceiling 60; a second housing 4 coupled to the first housing 2 and disposed at a penetration hole 5 formed at the ceiling 61; a deflector 6 disposed in the second housing 4 and adhered to the first housing 2 in a sealing-available manner, for maintaining a sealing state of a lower end of the first housing 2 in the ordinary time and spraying water all around at the time of a fire occurrence by being detached from the first housing 2; a locking unit 8 locked at an inner circumferential surface of the second housing 4 for supporting the deflector 6 so that the first housing 2 can be sealed; and a heat responding unit 10 exposed to outside of the ceiling 61 for sensing heat at the time of a fire occurrence and thus releasing a locking of the locking unit 8.

The first housing 2 includes: a male screw portion 12 formed at the upper portion of the first housing and connected to the water supply pipe 1; a flange portion 14 formed at the middle portion of the first housing 2 and having a female screw portion 32 at an inner circumferential surface thereof so as to be coupled to the second housing 4; and a water emitting portion 16 formed at a lower portion of the first housing and to which the deflector 6 is ascendably and descendably inserted, for emitting water.

The second housing 4 is formed as a cylindrical shape, and includes a first male screw portion 34 formed at an upper outer circumferential surface thereof and connected to the female screw portion 32 of the first housing 2; and a second male screw portion 38 formed at a lower outer circumferential surface thereof and connected to a bracket 36 supported at the ceiling 60. Also, a stopping protrusion 40 for stopping the deflector 6 is protruded with a certain width at an inner circumferential surface of the second housing 4 in a circumferential direction, and the stopping protrusion 40 is provided with a locking groove 44 formed in a circumferential direction for locking the locking ring 42 of the locking unit 8 by inserting.

The lower surface of the second housing 4 is positioned on the same plane as that of the ceiling 61 by the bracket 36.

The deflector 6 includes: a deflector ring 18 linear-movably inserted to an outer circumferential surface of the water emitting portion 16 and stopped by the stopping protrusion 40 of the second housing 4 when the deflector 6 is detached from the first housing 2; a sealing cap 22 adhered to a lower surface of the water emitting portion 16 of the first housing 2 for sealing the water emitting portion 16; a water spray plate 24 fixed to an outer circumferential surface of the sealing cap 22 for spraying water all around at the time of a fire occurrence; and a plurality of legs 20 for connecting the deflector ring 18 and the water spray plate 24.

An adjustment bolt 26 is coupled to a lower surface of the sealing cap 22, and the sealing between the sealing cap 22 and the water emitting portion 16 can be maintained by adjusting the adjustment bolt 26.

The locking portion 8 and the heat responding unit 10 include: a first loading plate 50 contacting a rear surface of the sealing cap 22 of the deflector 6 and having a screw hole 48 at the center thereof; a second loading plate 52 facing the first loading plate 50; a locking ring 42 disposed at the edge between the first loading plate 50 and the second loading plate 52 and locked at the locking groove 44 formed at the second housing 4 by being widened when the first loading plate 50 and the second loading plate 52 are adhered to each other; a plurality of heat collecting plates 54, 56, and 58 mounted at a lower side of the second loading plate 52 for collecting heat at the time of a fire occurrence; a fuse metal 60 disposed at a lower surface of the heat collecting plates 54, 56, and 58 and melted when heat collected through the heat collecting plates 54, 56, and 58 reaches a certain temperature; and a locking screw 62 coupled to the screw hole 48 formed at the first loading plate 50 for integrally coupling the first and second loading plates 50 and 52, the heat collecting plates 54, 56, and 58, and the fuse metal 60.

The first loading plate 50 and the second loading plate 52 are respectively provided with an inclination surface at the opposed edge, and the locking ring 42 is disposed between said two inclination surfaces. Thus, by fastening the locking screw 62, the first loading plate 50 and the second loading plate 52 are adhered to each thus to widen the locking ring 42 along the inclination surfaces, so that the locking ring 42 is locked at the locking groove 44 of the first housing 2.

The locking groove 44 formed at the inner circumferential surface of the second housing 4 is formed at the inner portion with a certain height L from the lower surface of the second housing 4, so that the locking ring 42, the first loading plate 50, and the second loading plate 52 are arranged with an inserted state towards the inside of the second housing 4.

Since the locking unit 8 and the heat responding unit 10 are inserted into the inside of the second housing 4 from the lower surface of the second housing positioned on the same plane as the lower surface of the ceiling 61 with the height L, the entire height R of the sprinkler head exposed from the ceiling 61 can be decreased.

Also, since the locking unit 8 is arranged with an inserted state towards the inside of the second housing 4, a certain space is formed at the lower portion of the second housing 4 and the space becomes an air flow collecting portion 70 for collecting heated air flow at the time of a fire occurrence and generating a swirl flow.

That is, when a fire breaks out, heated air flow is elevated thus to flow along the ceiling 61. The air flow is introduced into the air flow collecting portion 70 and temporarily stays with generating a swirl flow. According to this, heat is fast transmitted to the heat collecting plates 54, 56, and 58 positioned at the lower side of the air flow collecting portion 70 thus to enhance the heat collecting function of the heat collecting plates 54, 56, and 58. Therefore, the heat collecting plates are fast heated at the time of a fire occurrence thereby to enhance a responsiveness.

Centers of the heat collecting plates 54, 56, and 58 are penetrated so that the locking screw 62 can pass. The first heat collecting plate 54 is disposed with a certain interval from the lower surface of the second loading plate 52, and the second heat collecting plate 56 is disposed with a certain interval with the first heat collecting plate 54. Also, the third heat collecting plate 58 is disposed with a certain interval with the second heat collecting plate 56 and is provided with the fuse metal 60 at the lower surface thereof. The first, second, and third heat collecting plates 54, 56, and 58 have the same diameter.

The first heat collecting plate 54 is provided with a convex portion 72 protruded with a certain width downwardly at the center of the first heat collecting plate 54. The convex portion 72 is in contact with the upper surface of the second heat collecting plate 56, thereby maintaining the certain interval between the first heat collecting plate 54 and the second heat collecting plate 56.

A heat insulating washer 76 for preventing heat collected by the heat collecting plates from being transmitted to the first and second loading plates 50 and 52 is mounted between the first heat collecting plate 54 and the second heat collecting plate 56.

The second heat collecting plate 56 is formed as a disc type of which center is penetrated.

The third heat collecting plate 58 is provided with a convex portion 78 protruded upwardly at the center of thereof, and the edge of the third heat collecting plate 58 is extended upwardly with a certain height. The upper surface of the convex portion 78 of the third heat collecting plate 58 is in contact with the lower surface of the second heat collecting plate 56, thereby maintaining the certain interval between the second heat collecting plate 56 and the third heat collecting plate 58.

A concave portion 80 formed at the lower surface of the third heat collecting plate 58 is provided with the fuse metal 60, thereby transmitting heat collected by the first, second, and third heat collecting plates 54, 56, and 58 to the fuse metal 60.

The interval Q between the heat collecting plates 54,56, and 58 is formed to be much smaller than the interval between the conventional heat collecting plates, so that the sprinkler head can be positioned near the ceiling 61 as much as possible. Also, at the time of a fire occurrence, heated air flow introduced into the space among the heat collecting plates 54,56, and 58 transmits heat sufficiently to the heat collecting plates 54, 56, and 58 while staying for a certain time, and then the heated air passes though the heat collecting plates.

That is, heated air flow is elevated thus to flow in a lateral direction of the ceiling 61 at the time of a fire occurrence and to be introduced into the heat collecting plates 54, 56, and 58. Herein, since the interval between the heat collecting plates is small, a flow resistance is generated. Therefore, the air flow passes through the heat collecting plates slowly and thereby sufficiently transmits heat to surfaces of the heat collecting plates.

Accordingly, the heat collecting plates 54, 56, and 58 are faster heated at the time of a fire occurrence, thereby accelerating a responsiveness and thus enhancing a reliability of the product.

Assembly processes of the sprinkler head according to the present invention will be explained as follows.

First, the locking ring 42 is disposed between the first loading plate 50 and the second loading plate 52. Then, the heat insulating washer 76, the first, second, and third heat collecting plates 54, 56, and 58, and the fuse metal 60 are sequentially arranged at the lower side of the second loading plate 52. Subsequently, the locking ring 42 is positioned at the locking groove 44 of the second housing 4, and then the locking screw 62 is fastened. According to this, the first loading plate 50 and the second loading plate 52 are adhered to each other, and the locking ring 42 is widened along the inclination surfaces formed at the edges of the first and second loading plates 50 and 52 thus to be locked at the locking groove 44.

Then, the deflector 6 is inserted into the outer circumferential surface of the water emitting portion 16 of the first housing 2, and then the first housing 2 and the second housing 4 are coupled to each other.

Next, the adjustment blot 26 mounted at the lower surface of the sealing cap 22 of the deflector 6 is loosened by using a tool such as a wrench. The adjustment bolt 26 pushes the sealing cap 22 under a state of being supported at the first loading plate 50, thereby maintaining the sealing state between the sealing cap 22 and the lower surface of the water emitting portion 16 of the first housing 2.

When the assembly of the sprinkler head is completed, the male screw portion 12 formed at the upper portion of the first housing 2 is coupled to the water supply pipe 1 through the penetration hole 5 formed at the ceiling 61, and the second male screw portion 38 of the second housing 4 is coupled to the bracket 36 mounted at the penetration hole 5 of the ceiling 61, thereby completing to mount the sprinkler head to the ceiling.

Operation processes of the sprinkler head according to the present invention will be explained as follows.

Figure 6A:
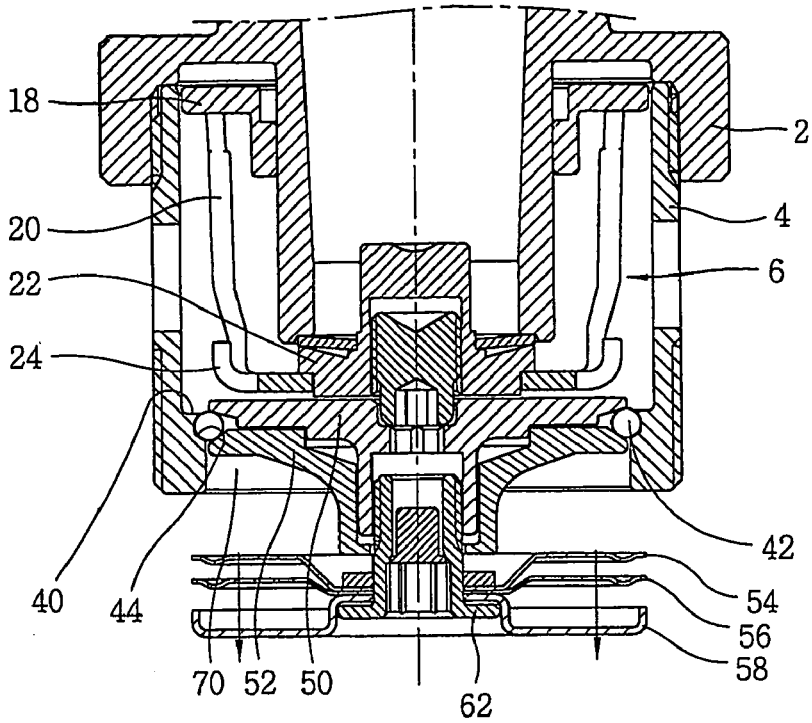
FIGS. 6A, 6B, and 6C are views showing operational states of the sprinkler head according to the present invention.
Figure 6B:
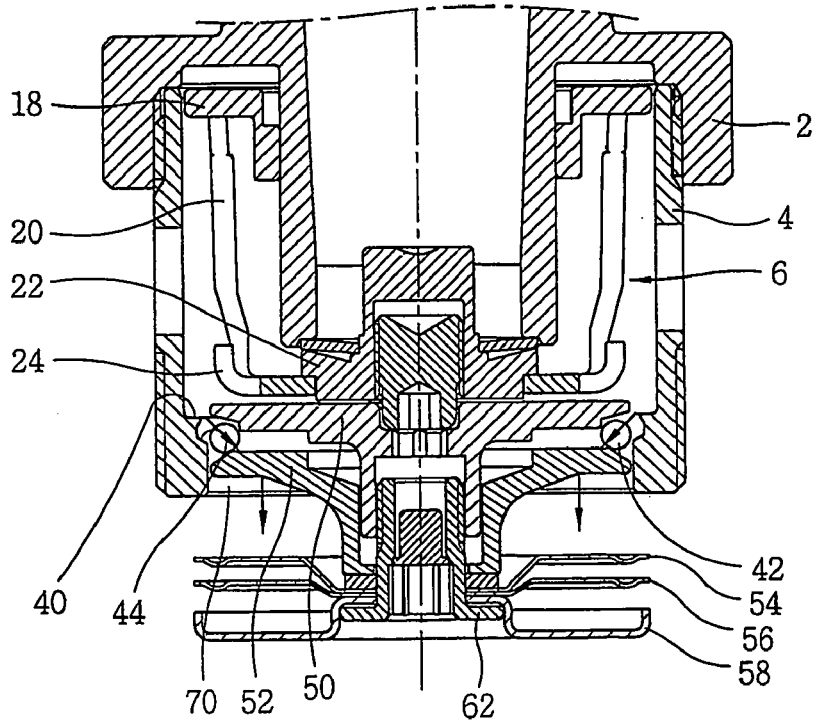
Figure 6C:
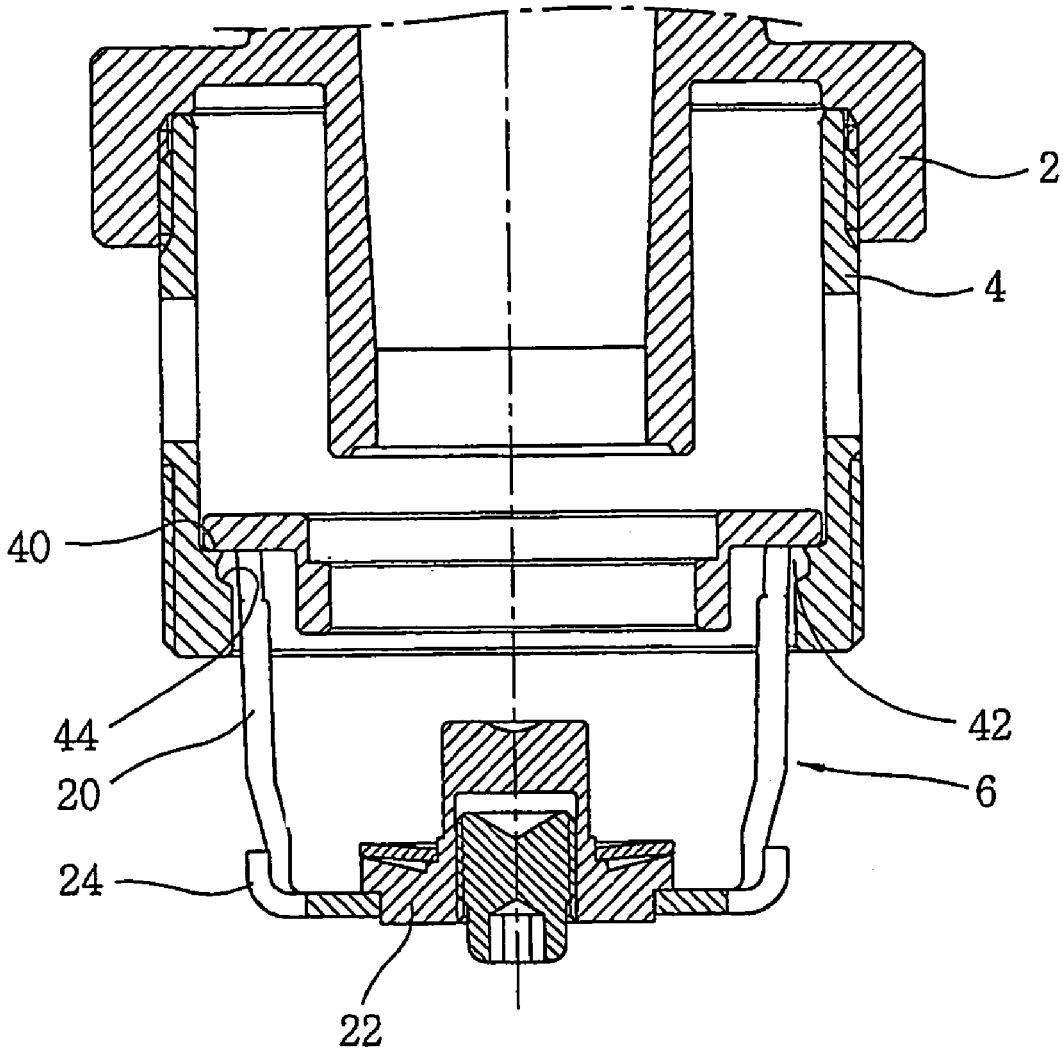

FIGS. 6A, 6B, and 6C are views showing operational states of the sprinkler head according to the present invention.

As shown in FIG. 6A, at the time of a fire occurrence under a state that the sprinkler head is assembled to the ceiling 61, heat air flow is elevated thus to flow along the ceiling and to be introduced into the air flow collecting portion 70 formed at the second housing 2. The air flow generates a swirl flow while staying temporarily, and thereby heat is fast transmitted to the first heat collecting plate 54 positioned at the lower side of the air flow collecting portion 70. Also, the air flow transmits heat to the heat collecting plates 54, 56, and 58 by passing through the space among the heat collecting plates 54, 56, and 58.

Herein, since the interval between the heat collecting plates 54, 56, and 58 is small, a flow resistance is generated at the air flow. According to this, the air flow passes through the heat collecting plates 54, 56, and 58 slowly and sufficiently transmits heat to the surfaces of the heat collecting plates 54, 56, and 58.

As above-explained, since the air flow is introduced into the air flow collecting portion 70 thus to generate a swirl flow and the air flow passes through the heat collecting plates 54, 56, and 58 slowly, heat is fast transmitted to the heat collecting plates 54, 56, and 58 and thereby the fuse metal 60 is fast melted.

Test data showing the reaction speed of the sprinkler head according to the present invention and the sprinkler head according to another embodiment of the conventional art will be explained.

First, when the sprinkler head according to the present invention was tested in a hermetic space under a state that an air flow temperature is 129~141° C. and an air flow speed is 1.65~1.85 ms, the reaction time was 16.4~17.8 sec and the response time index (RTI) was 36.7~39.6.

Herein, an equation of RTI=T×U (T denotes the reaction time and U denotes the air flow speed) is obtained.

However, when the sprinkler head according to another embodiment of the conventional art was tested in the same condition, the reaction time was 18.8~21 sec and the response time index (RTI) was 42~47.

Referring to the above test data, it can be seen that the sprinkler head according to the present invention has the response speed faster than that of the sprinkler head according to another embodiment of the conventional art.

As shown in FIG. 6B, as the interval between the first loading plate 50 and the second loading plate 52 is widened, the locking ring 42 is restored to the original state thus to be detached from the locking groove 44. According to this, the locking portion 8 and the heat responding unit 10 are detached from the second housing.

As shown in FIG. 6C, the deflector 6 is detached from the first housing 2 and thereby is stopped at the stopping protrusion 40 formed at the second housing 2. According to this, water drained through the second housing 4 spreads through the water spray plate 24 of the deflector 6 thus to suppress fire.

INDUSTRIAL APPLICABILITY

As so far described, according to the sprinkler head of the present invention, the locking portion and the heat responding unit exposed to outside of the ceiling are inserted into the second housing with a certain height, and the interval between the heat collecting plates of the heat responding unit is small, thereby positioning the sprinkler head near the ceiling as much as possible. According to this, the impact applied to the sprinkler head at the time of the ceiling construction or the indoor work is prevented, and thus the damage or mal-function of the sprinkler head can be prevented thereby to enhance the reliability of the product.

Also, the air flow collecting portion for collecting air flow and generating a swirl flow at the air flow is formed at the lower portion of the second housing, and the speed of the air flow passing through the heat collecting plates becomes slow by narrowing the interval between the heat collecting plates. According to this, heat can be sufficiently transmitted to the heat collecting plates thus to accelerate the reaction speed at the time of a fire occurrence, thereby enhancing the function of the product.

Additionally, the height of the sprinkler head exposed from the ceiling is reduced thus to make the appearance look fine, thereby making a fine indoor appearance.

The invention claimed is:

1. A sprinkler head comprising:

a first housing connected to a water supply pipe disposed inside a building ceiling;

a second housing coupled to the first housing and fixed to the ceiling surface;

a deflector adhered to the first housing in a sealing-available manner for spraying water all around at the time of a fire occurrence by being detached from the first housing;

a locking unit locked inside the second housing for maintaining the sealing state between the deflector and the second housing; and a heat responding unit exposed to outside of the ceiling for sensing heat at the time of a fire occurrence and thus releasing a locking of the locking unit;

wherein the second housing includes a locking groove formed at an inner side of the second housing in a recess from a lower surface of the second housing, a locking ring located at the locking groove, and first and second loading plates for pressurizing the locking ring to thus be widened, the locking unit being seated at the locking groove in the recess to reduce an exposure distance from the ceiling surface, the second housing extending vertically below a portion of the second loading plate such that the relative position of the locking unit with respect to the second housing forms a space between the second housing and the second loading plate, the formed space serving as an air flow collecting portion for collecting an air flow heated when a fire occurs and for generating a swirl flow in the air flow with the space.

2. The sprinkler head of claim 1, wherein the heat responding unit is composed of first, second, and third heat collecting plates, and the first, second, and third heat collecting plates have certain intervals therebetween in order to delay time that air flow passes at the time of a fire occurrence.

3. The sprinkler head of claim 2, wherein the first heat collecting plate is provided with a convex portion protruded with a certain width downwardly at the center thereof, the second heat collecting plate is formed as a disc type, the third heat collecting plate is provided with a convex portion protruded upwardly at the center of thereof whereby the first, second, and third heat collecting plates come in contact with each other sequentially, and the first, second, and the third heat collecting plates have the same diameter.

* * * * *